United States Patent [19]

Salandra

[11] Patent Number: 4,745,961

[45] Date of Patent: May 24, 1988

[54] RAPID PROCESS FOR FABRICATING IMPROVED DENTAL REFRACTORY MODELS

[75] Inventor: Anthony R. Salandra, Emerson, N.J.

[73] Assignee: J. F. Jelenko & Co., Armonk, N.Y.

[21] Appl. No.: 27,425

[22] Filed: Mar. 18, 1987

Related U.S. Application Data

[60] Continuation-in-part of Ser. No. 772,840, Sep. 5, 1985, abandoned, which is a division of Ser. No. 632,363, Jul. 19, 1984, abandoned, Continuation of Ser. No. 777,820, Sep. 19, 1985, abandoned, which is a continuation-in-part of Ser. No. 632,363, Jul. 19, 1984, abandoned.

[51] Int. Cl.[4] ..... B22C 3/00; A61C 11/00

[52] U.S. Cl. ..... 164/14; 164/45; 164/35; 164/138; 264/16; 433/213

[58] Field of Search ..... 164/14, 72, 138, 45, 164/34, 35; 433/213; 264/16, 17

[56] References Cited

U.S. PATENT DOCUMENTS 4,378,213 3/1983 Severg ..... 433/213

*Primary Examiner*—Kuang Y. Lin

[57] ABSTRACT

Time-consuming steps of drying the unhardened and porous refractory dental model, hardening the dried model, and applying multiple coatings of a lacquer spray onto the hardened model are eliminated by spraying the unhardened and porous model with a non-viscous solution of specified cyanoacrylates to thereby produce a final model which yields a mold providing an improved alloy casting dental prosthesis.

8 Claims, No Drawings

RAPID PROCESS FOR FABRICATING IMPROVED DENTAL REFRACTORY MODELS

This application is a continuation-in-part of my copending application Ser. No. 772,840, filed Sept. 5, 1985, assigned to the assignee hereof, which was a divisional of application Ser. No. 632,363, filed on July 19, 1984, both now abandoned.

This application also is a continuation of my copending application Ser. No. 777,820, filed Sept. 19, 1985, assigned to the assignee hereof, which was a continuation-in-part of application Ser. No. 632,363, filed on July 19, 1984, both now abandoned.

STATEMENT OF THE INVENTION

The present invention relates to dental prostheses, and more particularly to methods for fabricating improved dental refractory models for use in making the prostheses with need for less equipment, materials and inventory, in a substantially shorter period of processing time.

BACKGROUND AND SUMMARY OF THE INVENTION

Current procedures for making dental models require certain process steps to be carried out after the final unhardened and moisture containing porous refractory model is made, and prior to its waxing-up. These required process steps normally consume several hours and frequently resulted, among others, in the following: (a) the porous model, which has now been subjected to the drying and hardening steps would be softer than desired, while the lacquer or beeswax coatings on the hardened model would be more porous than desired, (b) the lacquer or beeswax coatings would be thicker than desired, often necessitating extra grinding and/or polishing of the ultimately formed alloy prostheses, (c) these coatings would have a rougher surface than desired to thereby cause similarly rough surfaces to form on the tissue side, for example, of the ultimately formed framework or dental prostheses, thus requiring correction, (d) the presence of some water vapor in the porous model which may not have been adequately dried in the drying or burn-out operations often causes bubbles or other surface defects to be present in the alloy prostheses.

The present invention substantially eliminates the aforementioned deficiencies by providing a simple spraying of a cyanoacrylate solution onto surfaces of the unhardened porous refractory model. The spraying step consumes but a few seconds to perform and renders unnecessary the heretofore required steps of drying the final porous refactory model in an oven, allowing the dried model to cool to room temperature, hardening the dried and cooled model, and spraying the hardened model with, or dipping it in, a lacquer or beeswax solution in an attempt to provide a shiny nonporous surface thereon.

DETAILED DESCRIPTION OF THE INVENTION

It is common practice when making a dental model that a negative impression initially be made of the patient's teeth and gums, or at least pertinent portions thereof. The negative impression, typically of wax, rubber, or other suitable material is usually sent to a dental laboratory where a skilled technician pours a quantity of casting material into the impression to produce a working model, or simulation of the patient's teeth and gums. In order that the working model remain undamaged, a duplicate model of stone, for example, may be made. A final model is then usually made of a porous refractory material, typically a phosphate bound investment. Since the model is porous and contains water, it should be thoroughly dried prior to hardening.

Typically, the drying process consumes at least one hour and comprises placing the porous model or models in a suitable laboratory oven at room temperature. The oven's controls are set initially between 105° and 120° C. for approximately ½ hour, and then at 175° to 190° C. for an additional ½ hour. It is understood that, under oridinary conditions, a plurality of models will be dried simultaneously by the laboratory and further treated. However, for purposes of description hereinafter, only a single model will be referred to.

The oven is next permitted to cool gradually to room temperature with the dried model therewithin.

The dried and cooled model may now be hardened by dipping the upper portion (tooth portion) including tissue surfaces thereof into a commercial refractory dipping solution which saturates the pores of the porous model (to approximately the extent of the dipping). Allowing the dipped model to bench-dry for about 20 minutes results in crystallization of the dipping solution in the pores to thereby yield a hardened model.

After the model has been hardened, several coatings of a commercial lacquer or beeswax are applied thereto, by spraying, dipping, brushing, and the like, to provide a nonporous shiny surface thereon, each coating requiring several minutes of drying time prior to the application of an additional coating. Several coatings are desirable in order to eliminate porosity; nothwithstanding, a model which has been insufficiently or improperly dried often causes vapor bubbles to penetrate the lacquered coatings during the burn-out operation, later described, to yield rough surfaces thereon, necessitating grinding and polishing of the formed alloy prosthesis, as aforementioned. Additionally, the plurality of lacquer or beeswax coatings produce a measurable thickness which may cause the resultant prosthesis to fit less than perfectly.

The time-consuming steps of drying, hardening, and lacquer spraying described above are no longer required in accordance with the present invention.

That is, the unhardened and porous model containing moisture therein may be sprayed directly with an application of a non-viscous cyanoacrylate solution which immediately penetrates into the pores of the model. The model is readily sprayed in a matter of seconds, and, if a second spraying application is desired, less than ½ minute is required between applications.

The surfaces of the sprayed model become very smooth and nonporous. The model is hardened to the extent the pores come in contact with, or saturated by, the cyanoacrylate solution, unlike the hardening of substantially only the surfaces of the model by the lacquer or beeswax application of the prior art.

Additionally, the surfaces of the model are harder and more scratch resistant when sprayed with the present solution, thus making the model virtually impossible to mar or damage when the wax-up or plastic pattern is applied thereto. Still further, the sprayed cyanoacrylate solution adds no measurable thickness to the model, and quite unexpectedly, completely inhibited any moisture remaining after burn-out from forming vapor bubble defects on the alloy casting, an important consideration, bearing in mind that the unhardened and porous model was not subjected to any prior drying operation.

Briefly, the cyanoacrylate comprises methyl 2-cyanoacrylate or ethyl 2-cyanoacrylate, or a combination thereof. The viscosity of the solution is made to approach that of water by the use of suitable solvents, typically acetone or amyl acetate.

More specifically, the sprayed cyanoacrylate solution comprises about 1 to 2 percent, by volume of the cyanoacrylate in any combination, and preferably about 1.5 percent, by volume, balance comprising a solvent of acetone or amyl acetate, i.e., about 99 to 98 percent, by volume thereof, and preferably about 98.5 percent. The viscosity of the resultant solution approximates the viscosity of water. The porosity and/or density of the refractory model being sprayed or brushed by the solution may indicate to one skilled whether more solvent or cyanoacrylate may be added to the solution.

After the model has been sprayed by the cyanoacrylate solution, the remaining process steps for fabricating the framework or prosthesis is identical with standard procedures.

That is, the wax pattern is luted to the model with a liquid glue and the waxed-up model placed upon a disposable seat sealed to a disposable ring of proper diameter into which the investment is poured. When investing, a thin stream of the investment is poured directly onto the model's teeth or ridge while suitably vibrating the assembly, care being exercised to insure that a bubble-free film of investment covers the entire pattern surface.

After the highest portion of the model is barely covered with the investment, disposable ring may be hand shaken while on the vibrator to insure the elimination of all bubbles before completing the pour to abour ¼ to ½" above the highest surface of the model.

The cast is allowed to set for ½ hour before removing the disposable ring and seat. After the passage of an additional ½ hour, the glaze formed on the upper surface of the inventment may be removed by grinding on a conventional dry model trimmer. The resultant established mold, with sprue hole facing downwardly, may now be placed in a cold burn-out furance, its temperature raised to reach 540°–650° C. in one hour. The furnance temperature is then raised to about 954° C., and held thereat for at least ½ hour, resulting in the burning out of the wax pattern to thereby leave a void which replicates the burnt out wax pattern.

Molten alloy, typically a chrome cobalt alloy, is forced into the mold to fill the void formerly occupied by the pattern, thus providing the desired framework or prosthesis. Since the model may yet contain moisture not completely expelled during burn-out, it happens more than occasionaly that vapor bubbles form somewhere on the alloy casting, including tissue surfaces thereof, when the prior art process steps are employed. The prosthesis must be polished and finished, using standard procedures, and sent to the dentist for fitting to the patient.

The alloy prosthesis is completely devoid of vapor bubble defects however when the model is made in accordance with the present invention.

Summaryizing, the present invention renders unnecessary the time-consuming steps including drying of the unhardened, porous, moisture-containing model, hardening the dried model, and multiple spraying of the hardened model with lacquer. In lieu thereof, a solution of methyl 2-cyanoacrylate or ethyl 2-cyanoacrylate, or any combination thereof, having a viscosity approaching water, is sprayed directly onto the unhardened, porous moisture-containing refractory model in a matter of seconds. A second spraying, if desired, may be made within ½ minute after the first spraying.

The resultant model is nonporous, shiny, and scratch resistant. Even though the unhardened and porous refractory model has not been dried, as required by existing procedures, the hardened cyanoacrylate spray completely inhibited the formation of any vapor bubbles or other defects on the alloy casting. Further, the sprayed cyanoacrylate coating or coatings added no measurable thickness to the final model.

What is claimed is:

1. A process of fabricating a dental model comprising providing an unhardened, porous refractory model containing moisture therein, the outer surface of said model having pore openings in it, and applying a solution containing about 1 to 2 percent by volume of an element of the group consisting of methyl 2-cyanoacrylate and ethyl 2-cyanoacrylate in a solvent to said outer surface, whereby the viscosity of the solution is made to approximate that of water, to quickly penetrate said pores and to make said outer surface smooth and nonporous, whereby said model is hardened, and said outer surface is made nonporous and smooth by said applying.

2. The process of claim 1 wherein said solvent comprises a solvent selected from the group containing acetone and amly acetate.

3. The process of claim 1 further comprising after said applying, luting a waxed-up pattern to said model, investing said model with said luted waxed-up pattern to provide a mold for casting a prosthesis, burning out said waxed-up pattern to produce a replicated void thereof, and introducing molten alloy into said mold to fill said void to form a cast alloy prosthesis, said cast alloy prosthesis being free of vapor bubble defects on surfaces thereof due to said contained moisture escaping thereinto.

4. The process of claim 1 wherein the step of applying said non-viscous solution to said unhardened and porous refractory model comprises spraying.

5. The process of claim 4 further characterized by the steps of permitting said cyanoacrylate solution to dry in a period less than one-half minute, and spraying another application of said cyanoacrylate solution on said model.

6. The process of claim 4 wherein said cyanoacrylate solution provides no measurable thickness to said model.

7. The process of claim 5 wherein said cyanoacrylate solution provides no measurable thickness to said model.

8. The process of claim 1 wherein said cyanoacrylate is about 1.5 percent by volume.

* * * * *